US005820177A

United States Patent [19]

Moon

[11] Patent Number: 5,820,177

[45] Date of Patent: Oct. 13, 1998

[54] AUTOMATIC DEADBOLT

[75] Inventor: Charles W. Moon, Colorado Springs, Colo.

[73] Assignee: Winfield Locks, Inc., Costa Mesa, Calif.

[21] Appl. No.: 846,842

[22] Filed: May 1, 1997

[51] Int. Cl.[6] ..... E05B 63/20

[52] U.S. Cl. ..... 292/335; 292/DIG. 38

[58] Field of Search ..... 292/335, 169.14, 292/169.17, 336, DIG. 38; 70/106, 142, 471, 480

[56] References Cited

U.S. PATENT DOCUMENTS

| | | | |
|---|---|---|---|
| 289,542 | 12/1883 | Krings . | |
| 416,181 | 12/1889 | O'Keefe . | |
| 1,133,962 | 3/1915 | Hoglund | 292/335 |
| 1,302,873 | 5/1919 | Stiff | 292/335 |
| 1,808,219 | 6/1931 | Hall . | |
| 2,073,149 | 3/1937 | Geyer | 292/DIG. 38 |
| 2,382,762 | 8/1945 | Wirz | 292/335 |
| 2,519,808 | 8/1950 | Young et al. . | |
| 2,908,523 | 10/1959 | Foster . | |
| 3,621,686 | 11/1971 | Klein . | |
| 3,688,531 | 9/1972 | Hawkins . | |
| 4,109,948 | 8/1978 | Potter | 292/DIG. 38 |
| 4,118,056 | 10/1978 | Alexander . | |
| 4,561,684 | 12/1985 | Marotto . | |
| 4,679,416 | 7/1987 | Kambic | 70/480 |
| 4,739,638 | 4/1988 | Lin | 292/335 |
| 4,765,663 | 8/1988 | Raymond et al. . | |
| 4,890,870 | 1/1990 | Miron . | |

*Primary Examiner*—Steven N. Meyers
*Assistant Examiner*—Gary Estremsky
*Attorney, Agent, or Firm*—Reising, Ethington, Learman & McCulloch, PLLC

[57] ABSTRACT

A mortise lock assembly is provided for mounting in a door opposite a strike plate on a door jamb. The assembly includes an automatic deadbolt feature with a bolt retractor arm that directly contacts and applies inward retraction pressure to a latch bolt and a deadbolt in response to bolt retractor hub rotation to retract the latch bolt and the deadbolt. Two deadbolt stops engage two housing stops when the deadbolt reaches the deadbolt extended position and restrain the deadbolt against further outward movement. Coil extension springs continuously bias the deadbolt and the latch bolt against retraction. A dead lock blocker releasably holds the deadbolt in the deadbolt extended position. The bolt retractor arm is additionally engageable with the blocker to release the blocker in response to bolt retractor hub rotation. A trigger releasably engages and retains the deadbolt in the deadbolt retracted position. The trigger releases the deadbolt when the door closes and the door jamb drives a bolt portion of the trigger inward. Forming the trigger bolt from a low-friction plastic such as DUPONT DELRIN® minimizes door closing forces.

27 Claims, 6 Drawing Sheets

AUTOMATIC DEADBOLT

TECHNICAL FIELD

This invention relates generally to a door-mounted mortise lock assembly that includes a deadbolt that is automatically thrown to the extended and locked position when the door is closed.

BACKGROUND OF THE INVENTION

Mortise locks employing automatic deadbolts are often used in hotel room doors and the like so that hotel guests need not independently and manually throw the deadbolts after closing their hotel room doors. A mortise lock of this type, with a deadbolt that automatically extends upon door closing, is shown in U.S. Pat. No. 298,542 issued to Krings on Dec. 4, 1883.

Another automatic deadbolt system is shown in U.S. Pat. No. 4,890,870, issued to Miron on Jan. 2, 1990 and assigned to the assignee of this invention. The Miron patent discloses a mortise lock assembly with a deadbolt that is automatically thrown to an extended position and manually withdrawn to a retracted position. The deadbolt is released to move automatically to an extended position when a trigger bolt hits a strike plate on the door jam as the door containing the mortise lock assembly is being closed. The trigger bolt drives a trigger link downward which releases the spring-loaded deadbolt to move to its extended position. The deadbolt can be manually thrown by turning a door handle, which causes a bolt retractor arm to engage a deadbolt hub, which, in turn, engages the deadbolt causing the deadbolt to retract. The deadbolt hub also releasably deadlocks the deadbolt in its engaged position. The bolt retractor arm transfers motion from the door handle to the deadbolt indirectly through the deadbolt hub.

The assignee of the present invention has also manufactured the mortise lock assembly shown at 11 in FIG. 1 of the drawings. The mortise lock assembly 11 of FIG. 1 mounts in a door opposite a strike plate on a doorjamb (not shown). The assembly 11 includes a deadbolt 13 reciprocally movable within a housing 15. A bolt portion 17 of the deadbolt 13 protrudes outward from the housing 15 in a deadbolt extended position and is disposed generally within the housing 15 in a deadbolt retracted position. The deadbolt 13 comprises a single deadbolt stop 19 that engages a single housing stop 21 when the deadbolt 13 is thrown to the deadbolt extended position. The stops restrain the deadbolt against further outward movement past the deadbolt extended position.

A deadbolt biasing mechanism includes a torsion spring 23 that continuously biases the deadbolt 13 outwardly toward the deadbolt extended position. A deadbolt hub 25 deadlocks the deadbolt 13 in the deadbolt extended position to releasably restrain the deadbolt 13 against inward movement. The rotary position of the deadbolt hub 25 also serves the ancillary function of signaling a microprocessor (not shown) whether or not the room behind the door is occupied.

A deadbolt trigger is actuated to release the deadbolt from its retracted position. The trigger includes a trigger bolt 27 and a trigger link 29. The trigger link 29 releasably engages and retains the deadbolt 13 in the deadbolt-retracted position. A bolt portion 31 of the trigger bolt 27 protrudes outward from the housing 15 in a trigger bolt extended position and is disposed generally within the housing 15 in a trigger bolt inserted position. As the trigger bolt 27 is driven inward a cam follower 33 on the trigger bolt 27 engages a ramped cam surface 35 in a trigger link cam slot, driving the trigger link 29 downward and releasing the deadbolt 13.

As is also shown in FIG. 1, a pair of bolt retractor hubs 37 is journaled to rotate within the housing 15. In response to bolt retractor hub rotation, a bolt retractor arm 39 engages the deadbolt hub 25, causing the deadbolt hub 25 to rotate and unblock the deadbolt 13. After unblocking the deadbolt 13, the bolt retractor arm 39 continues to apply inward pressure to the deadbolt hub 25 which continues to rotate and retracts the deadbolt 13 by applying inward pressure to a deadbolt tailpiece 41 through a downwardly-extending deadbolt hub arm 43.

Prior art mortise lock assemblies that employ automatic deadbolts sometimes require excessive force to manually retract the deadbolt. Some also require high door closing forces to release the automatic deadbolt. The consequences of such high force requirements can include over-stressing and breakage of deadbolt biasing springs and deadbolt tailpieces. What is needed is a mortise lock assembly with an automatic deadbolt feature that operates quieter, more smoothly, more reliably and that requires less force to operate.

SUMMARY OF THE INVENTION

In accordance with this invention, a mortise lock assembly is provided for mounting in a door opposite a strike plate on a doorjamb. The assembly includes an automatic deadbolt feature with a bolt retractor arm that directly contacts and applies inward pressure to the deadbolt in response to bolt retractor hub rotation. This minimizes the amount of rotational force that an operator must apply via a door handle to the bolt retractor hub to move the deadbolt from the deadbolt engaged position to the deadbolt retracted position.

The assembly also includes a deadbolt reciprocally movable within a housing between a deadbolt extended position and a deadbolt retracted position. A portion of the deadbolt protrudes outward from the housing in the deadbolt extended position and is disposed within the housing in the deadbolt retracted position. The deadbolt comprises a first deadbolt stop and the housing comprises a first housing stop engageable with the first deadbolt stop when the deadbolt is in the deadbolt extended position. The stops cooperate to restrain the deadbolt against further outward movement. A deadbolt biasing mechanism is mounted within the housing and continuously biases the deadbolt outwardly toward the deadbolt extended position. A dead lock blocker is mounted within the housing and is engageable with the deadbolt when the deadbolt is in the deadbolt extended position to releasably restrain the deadbolt against inward movement. A deadbolt trigger comprises a trigger bolt that is reciprocally moveable within the housing between a trigger bolt extended position and a trigger bolt inserted position. A portion of the trigger bolt protrudes outward from the housing in the trigger bolt extended position and is disposed within the housing in the trigger bolt-inserted position. The trigger releasably engages and retains the deadbolt in the deadbolt retracted position when the trigger bolt is in the trigger bolt extended position. The trigger releases the deadbolt from the deadbolt retracted position when the trigger bolt is driven inward toward the trigger bolt inserted position. A bolt retractor hub is journaled to rotate within the housing. The bolt retractor arm is operatively connected to the blocker to release the blocker in response to bolt retractor hub rotation.

According to another aspect of the invention, a trip surface is disposed on the bolt retractor arm and applies direct pressure to the blocker arm in response to bolt retractor hub rotation. This moves the blocker out of the dead lock position and frees the deadbolt to move out of the deadbolt extended position.

According to another aspect of the invention, a latch bolt is reciprocally movable within the housing between a latch bolt extended position and a latch bolt retracted position. A portion of the latch bolt protrudes outward from the housing in the latch bolt extended position and is disposed generally within the housing in the latch bolt retracted position. A latch bolt biasing mechanism is mounted within the housing and biases the latch bolt toward the latch bolt extended position. The bolt retractor arm operatively engages the latch bolt to move the latch bolt to the latch bolt retracted position in response to hub rotation.

According to another aspect of the invention, the deadbolt is engageable and retainable in a deadbolt semi-retracted position when the trigger bolt is in the trigger bolt extended position. The deadbolt semi-retracted position is spaced incrementally outward from the deadbolt retracted position toward the deadbolt extended position. The deadbolt is releasable from the deadbolt semi-retracted position when the trigger bolt is driven inward toward the trigger bolt inserted position.

According to another aspect of the invention, the deadbolt includes first and second trigger detents disposed in an outer surface of the deadbolt. The trigger includes a deadbolt engagement edge that is selectively engageable with the trigger detents. The deadbolt engagement edge engages the first trigger detent when the deadbolt is in the deadbolt retracted position and engages the second trigger detent when the deadbolt is in the deadbolt semi-retracted position.

According to another aspect of the invention, the trigger detents and the deadbolt engagement edge are disposed transverse to the direction of deadbolt movement.

According to another aspect of the invention, the trigger includes a trigger link mounted in the housing for reciprocal movement between a trigger link engaged position and a trigger link retracted position. The trigger includes a trigger biasing mechanism mounted within the housing. The trigger biasing mechanism continuously biases the trigger link toward the trigger link engaged position. The trigger includes a deadbolt engagement edge disposed on the trigger link. The engagement edge engages the trigger detents when the trigger link is in the trigger link engaged position. The trigger includes a trigger bolt that is operatively connected to the trigger link and that drives the trigger link to the trigger link retracted position when the trigger bolt moves from the trigger bolt extended position toward the trigger bolt inserted position.

According to another aspect of the invention, the trigger bolt comprises a material that possesses sufficient natural lubricity to provide the trigger bolt with a friction coefficient less than that of steel.

According to another aspect of the invention, the trigger bolt comprises a metal cam follower that is operatively engageable with a cam slot in the trigger link.

According to another aspect of the invention, the trigger biasing mechanism includes a double-acting spring that biases the trigger bolt outward toward the trigger bolt extended position while biasing the trigger link toward the trigger link engaged position.

According to another aspect of the invention, the dead lock blocker includes a blocker arm mounted in the housing for reciprocal movement between a dead lock position and a blocker retracted position. The dead lock blocker also includes a blocker biasing mechanism mounted within the housing. The blocker biasing mechanism continuously biases the blocker arm toward the dead lock position. The blocker arm releasably engages the deadbolt when the deadbolt is in the deadbolt extended position and the blocker arm is in the dead lock position, According to another aspect of the invention, a deadbolt biasing mechanism includes a coil extension-type throw spring that is mounted within the housing. The throw spring continuously biases the deadbolt outwardly toward the deadbolt extended position. The coil spring has a longitudinal spring axis that is aligned generally parallel to the direction that the spring applies biasing force to the deadbolt.

According to another aspect of the invention, the deadbolt biasing mechanism includes an elongated spring rod coaxially disposed within the throw spring. The spring rod has a first end that is fixed to the housing and a second end that is slidably supported within an aperture disposed within the deadbolt. The spring diameter is greater than that of the aperture and the spring disposed between the housing and the deadbolt aperture.

According to another aspect of the invention, the spring and spring rod are slidably disposed within an elongated slot formed in a tailpiece portion of the deadbolt.

According to another aspect of the invention, the deadbolt comprises aluminum.

According to another aspect of the invention, the deadbolt comprises first and second deadbolt stops and the housing comprises first and second housing stops. The first and second housing stops engage the respective first and second deadbolt stops when the deadbolt is in the deadbolt extended position. The stops restrain the deadbolt against further outward movement.

According to another aspect of the invention, the first deadbolt stop is disposed above the bolt portion of the deadbolt and the second deadbolt stop is disposed below the bolt portion of the deadbolt.

According to another aspect of the invention, the deadbolt stops are disposed forward of a deadbolt tailpiece center of mass.

According to another aspect of the invention, the trigger bolt comprises a metal cam follower that is operatively engageable with a cam slot in the trigger link.

According to another aspect of the invention, the deadbolt is engageable and retainable in a deadbolt semi-retracted position when the trigger bolt is in the trigger bolt extended position. The deadbolt semi-retracted position is spaced incrementally outward from the deadbolt retracted position toward the deadbolt extended position. The deadbolt is releasable from the deadbolt semi-retracted position when the trigger bolt is driven inward toward the trigger bolt inserted position.

According to another aspect of the invention, the deadbolt includes first and second trigger detents disposed in an outer surface of the deadbolt. The trigger includes a deadbolt engagement edge that is selectively engageable with the trigger detents. The deadbolt engagement edge engages the first trigger detent when the deadbolt is in the deadbolt retracted position and engages the second trigger detent when the deadbolt is in the deadbolt semi-retracted position.

According to another aspect of the invention, the trigger detents and the deadbolt engagement edge are disposed transverse to the direction of deadbolt biasing force application.

According to another aspect of the invention, the trigger includes a trigger link mounted in the housing for reciprocal movement between a trigger link engaged position and a trigger link retracted position. A trigger biasing mechanism is mounted within the housing and continuously biases the trigger link toward the trigger link engaged position. The deadbolt engagement edge is disposed on the trigger link. The edge engages the trigger detents when the trigger link is in the trigger link engaged position. The trigger bolt is operatively connected to the trigger link and drives the trigger link to the trigger link retracted position when the trigger bolt moves from the trigger bolt extended position toward the trigger bolt inserted position.

According to another aspect of the invention, the trigger biasing mechanism includes a double-acting spring that biases the trigger bolt outward toward the trigger bolt extended position while biasing the trigger link toward the trigger link engaged position.

BRIEF DESCRIPTION OF THE DRAWINGS

To better understand and appreciate the invention, refer to the following detailed description in connection with the accompanying drawings.

DETAILED DESCRIPTION OF THE PREFERRED EMBODIMENT

Figure 1:
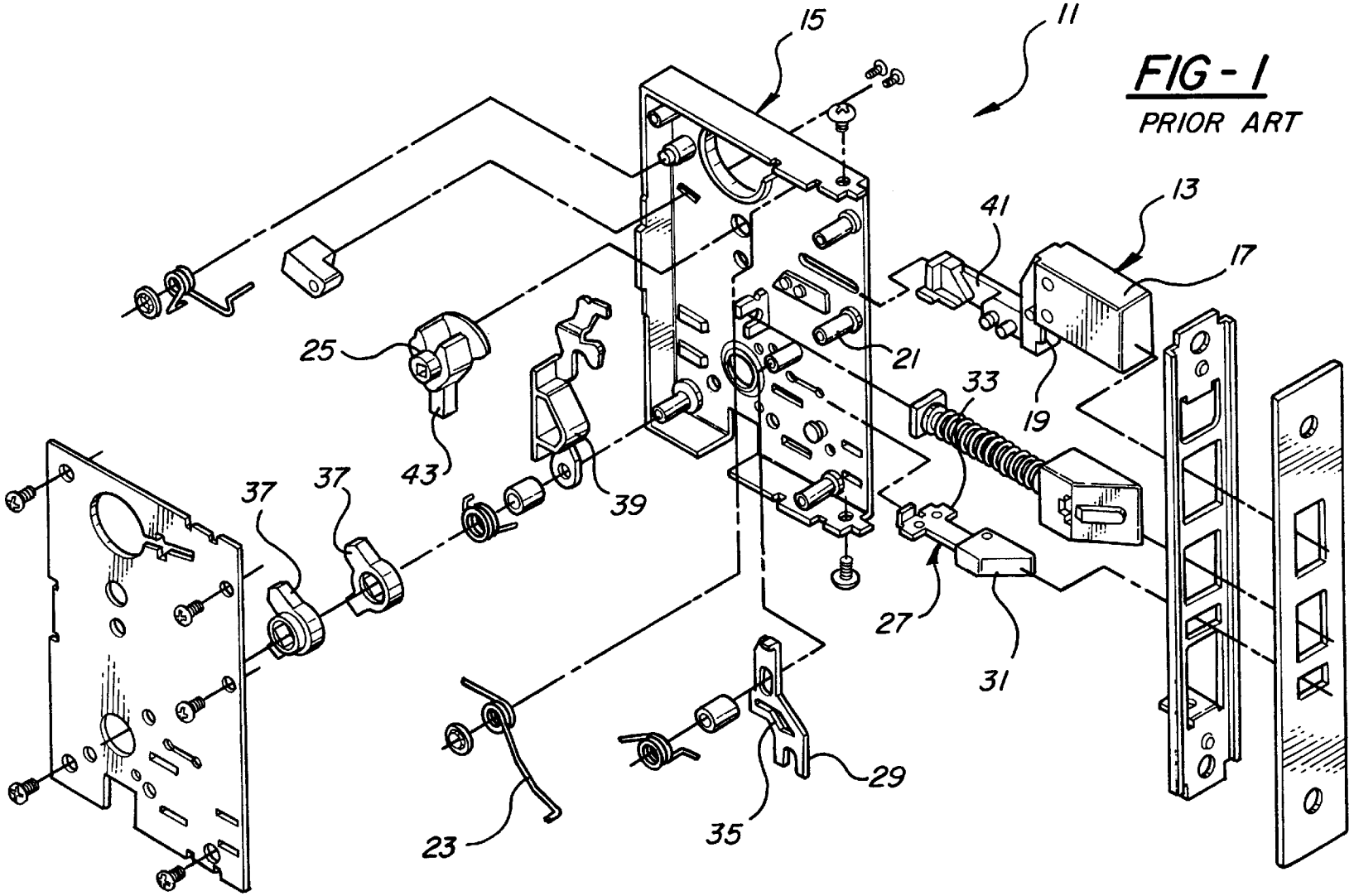
FIG-1 PRIOR ART
FIG. 1 is an exploded view of a prior art mortise lock assembly employing an automatic deadbolt.
Figure 2:
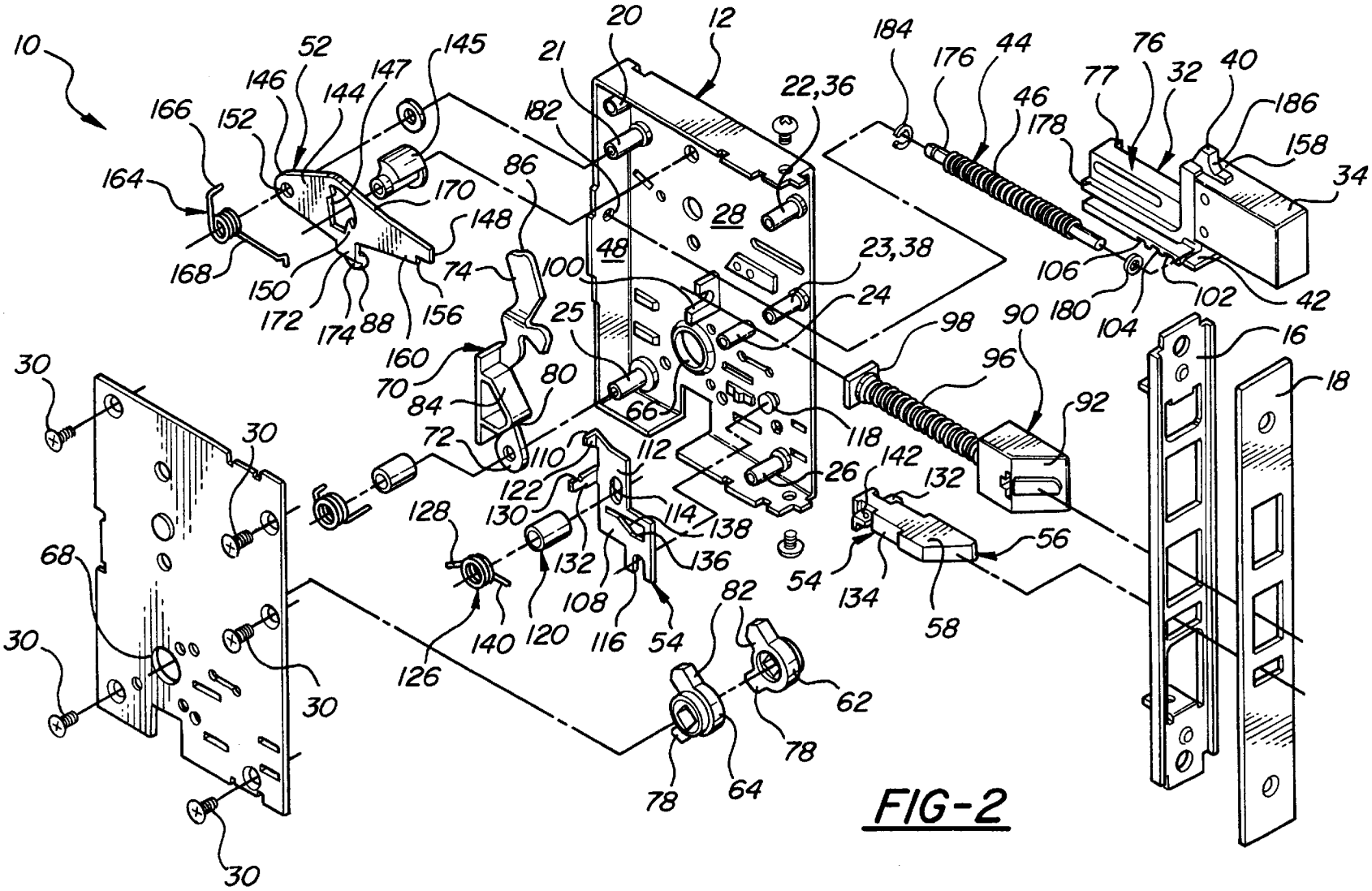
FIG. 2 is a an exploded view of a mortise lock assembly constructed according to the invention.

A mortise lock assembly for mounting in a door opposite a strike plate on a door jamb is generally shown at 10 in FIGS. 2–6. The assembly 10 includes a steel housing comprising a case 12, a side cover 14, an inside front plate 16 and outside front plate 18. As is best shown in FIG. 2, six transverse posts 20–26 integrally extend from a side wall 28 of the case 12. A threaded hole extends axially into each of five of the posts 20–23, 25, and 26 from a distal outer end of each of the five posts. The posts 20–26 space the side cover 14 from the side wall 28. The five interiorly threaded posts 20–23, 25, 26 provide screw holes for five case screws 30 that fasten the side cover 14 to the case 12.

Figure 3:
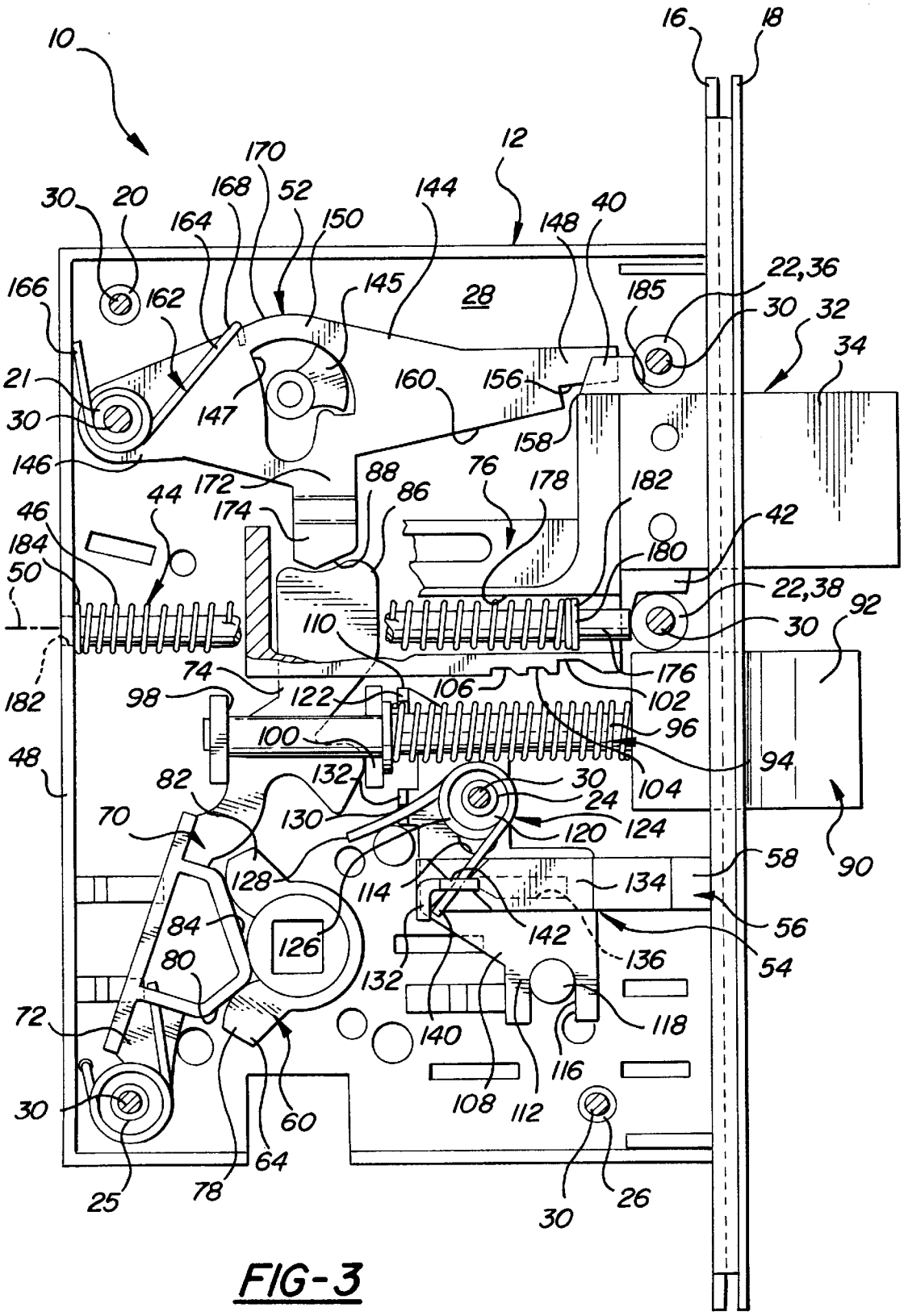
FIG. 3 is a partially cut-away side view of the mortise lock assembly of FIG. 2 with a dead bolt and a latch bolt in extended positions, a trigger bolt in a retracted position and a dead lock blocker in a dead lock position.
Figure 4:
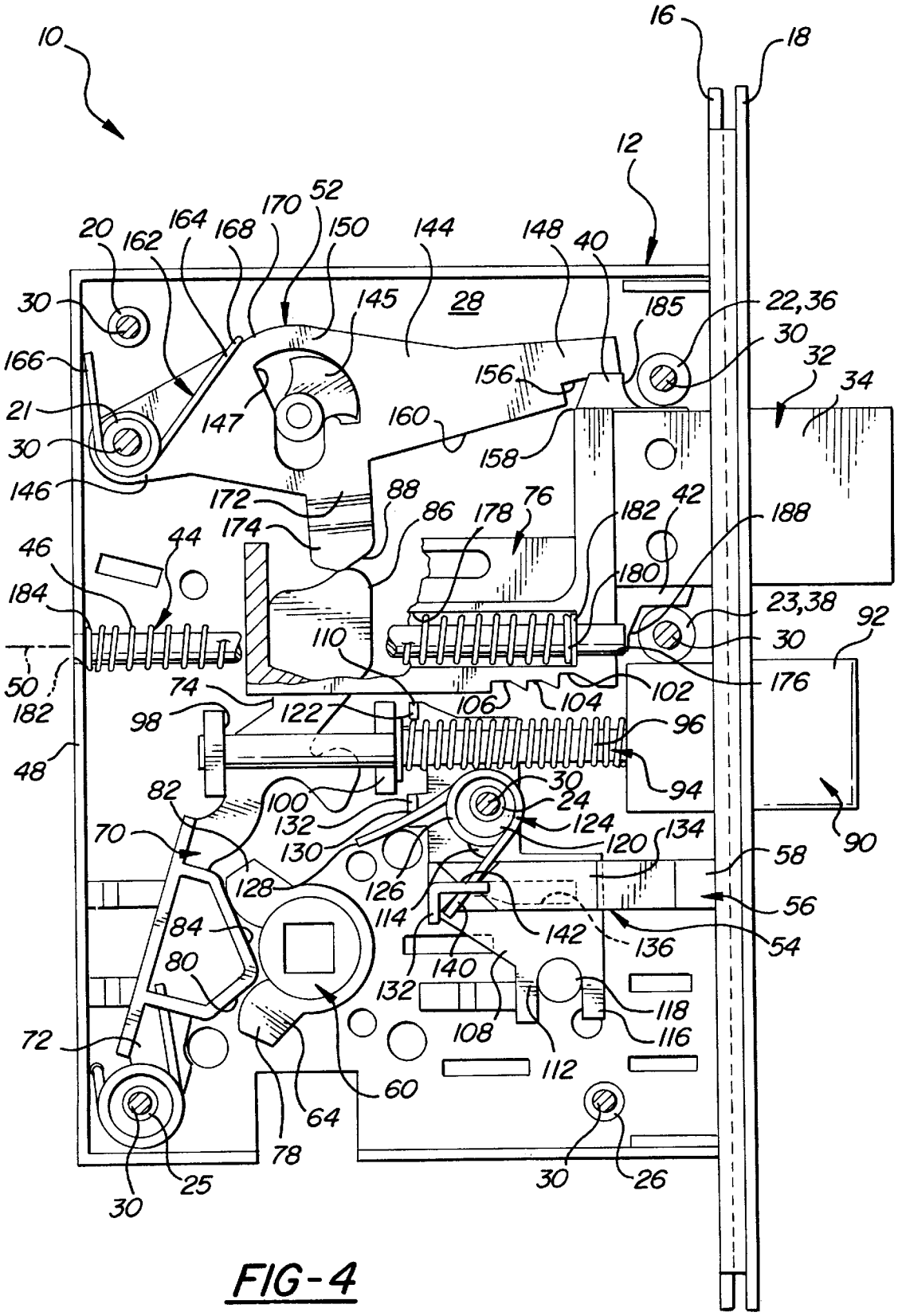
FIG. 4 is a partially cut-away side view of the mortise lock assembly of FIG. 2 with the dead bolt and latch bolt in their extended positions, the trigger bolt in its retracted position and the dead lock blocker out of the dead lock position.
Figure 5:
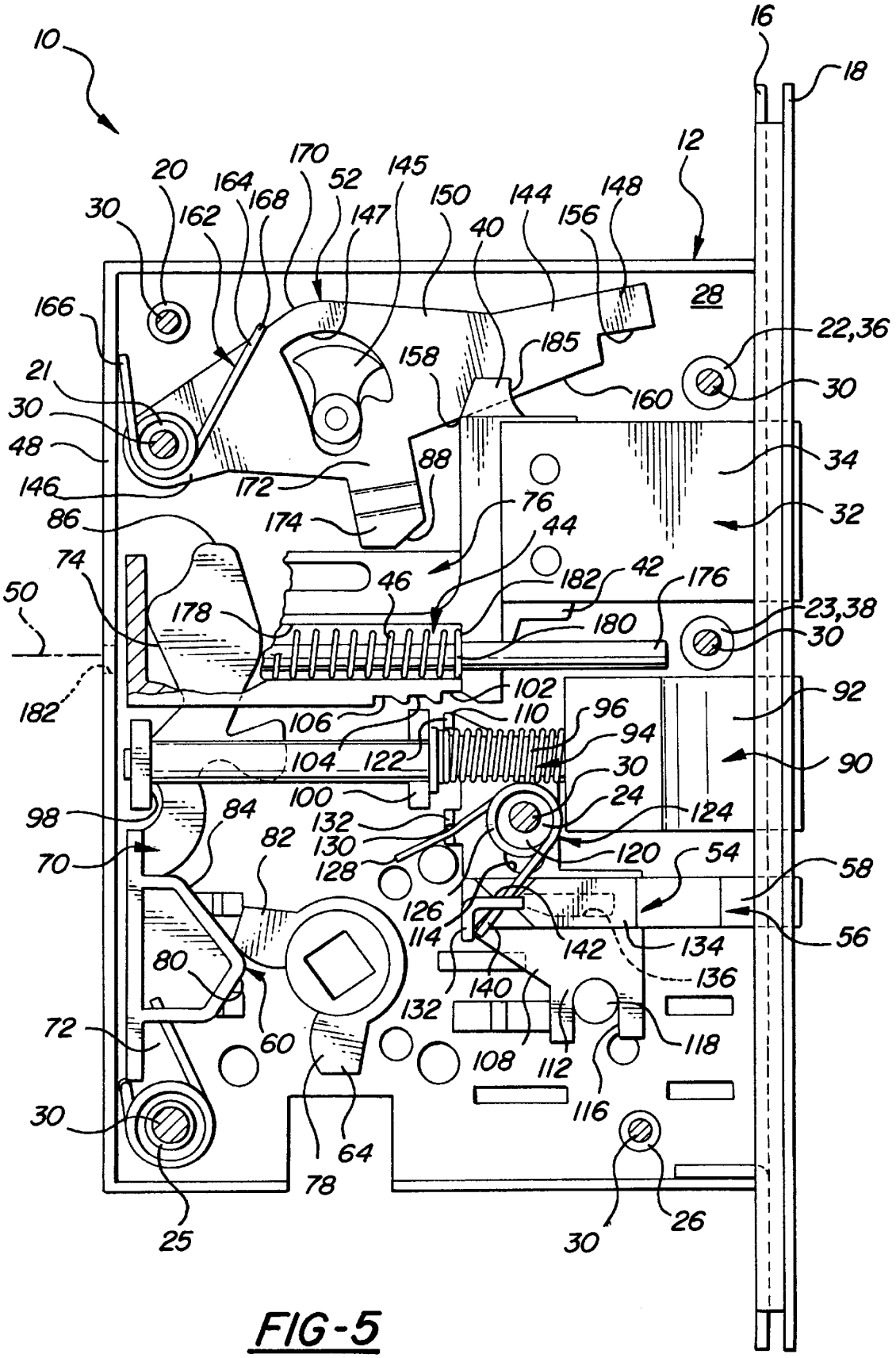
FIG. 5 is a partially cut-away side view of the mortise lock assembly of FIG. 2 with the dead bolt, latch bolt and trigger bolt in retracted positions and the dead lock blocker out of the dead lock position.
Figure 6:
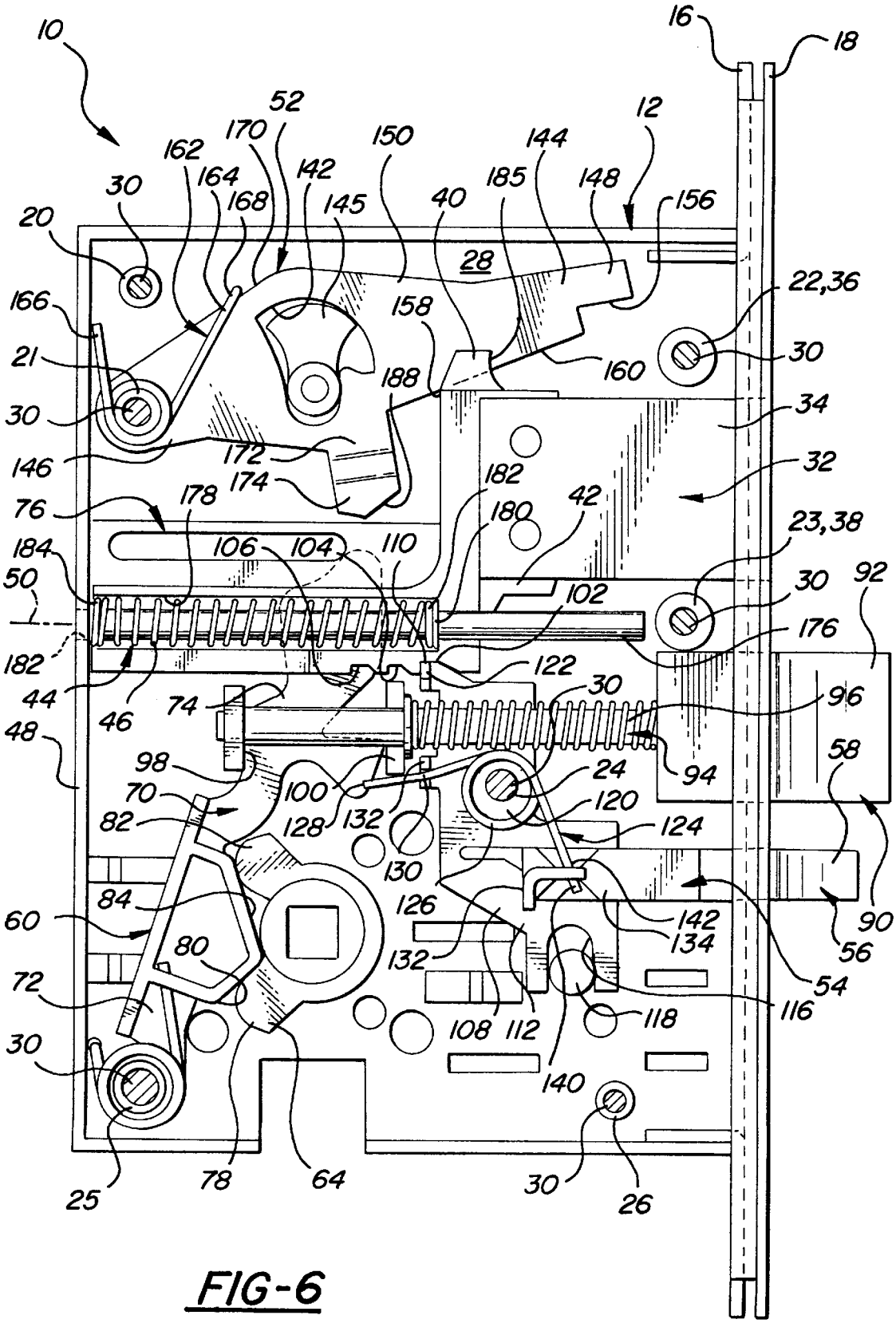
FIG. 6 is a partially cut-away side view of the mortise lock assembly of FIG. 2 with the dead bolt in its retracted position, the latch bolt and trigger bolt in extended positions, and the dead lock blocker out of the dead lock position.

A deadbolt, generally indicated at 32 in FIGS. 2–6, is reciprocally movable within the housing between a deadbolt extended position shown in FIG. 3, and a deadbolt retracted position shown in FIGS. 5 and 6. A brass bolt portion 34 of the deadbolt 32 protrudes outward from the housing in the deadbolt extended position as shown in FIG. 3. The bolt portion 34 is disposed almost completely within the housing in the deadbolt retracted position as shown in FIGS. 5 and 6. Two steel pins (not shown) are embedded in the bolt portion 34 of the deadbolt 32 to make the bolt portion 34 more resistant to being sawed through.

The housing includes first and second housing stops, shown at 36 and 38 in FIGS. 2–6, that engage respective first and second deadbolt stops, shown at 40 and 42 in FIGS. 2–6, when the deadbolt 32 is in the deadbolt extended position shown in FIG. 3. The stops 36–42 restrain the deadbolt 32 against further outward movement past the deadbolt extended position.

As best shown in FIG. 4, the stops 36–42 are positioned to engage simultaneously when the deadbolt 32 moves into the deadbolt extended position. The positioning of the first stops 36, 40 and the second stops 38, 42 divides the load between the first 36, 40 and second 38, 42 stops and prevents the deadbolt 32 from cocking when the deadbolt 32 hits the extended position.

The assembly 10 also includes a deadbolt biasing mechanism, generally indicated at 44 in FIGS. 2–6. The deadbolt biasing mechanism 44 includes a coil extension throw spring 46 that is mounted within the housing between the deadbolt 32 and a back wall 48 of the housing. The throw spring 46 continuously biases the deadbolt 32 outwardly toward the deadbolt extended position and has a longitudinal spring axis 50 that is aligned in a generally parallel disposition in relation to the direction that the throw spring 46 applies biasing force to the deadbolt 32. Coil extension springs of this type provide a gradual spring-rate curve so that the amount of force required to retract the deadbolt 32 is not significantly greater in or near the deadbolt retracted position as it is in the deadbolt extended position.

A dead lock blocker, generally indicated at 52 in FIGS. 3–6, is mounted within the housing and is engageable with the deadbolt 32 when the deadbolt 32 is in the deadbolt extended position shown in FIG. 3. The blocker 52 releasably restrains the deadbolt 32 against inward movement.

The assembly 10 also includes a deadbolt trigger, generally indicated at 54 in FIGS. 2–6. The deadbolt trigger 54 comprises a trigger bolt, generally indicated at 56 in FIGS. 2–6. The trigger bolt 56 is reciprocally moveable within the housing between a trigger bolt extended position shown in FIGS. 3, 4 and 6, and a trigger bolt inserted position shown in FIG. 5. The trigger bolt 56 comprises a polymeric material, preferably an acetyl resin that possesses a high degree of natural lubricity. The natural lubricity provides the trigger bolt 56 with a friction coefficient that is lower than steel.

A bolt portion 58 of the trigger bolt 56 protrudes outward through the front plates 16, 18 of the housing in the trigger bolt extended position shown in FIG. 6. The bolt portion 58 of the trigger bolt 56 is disposed within the housing in the trigger bolt inserted position shown in FIGS. 3, 4 and 5. The trigger 54 releaseably engages and retains the deadbolt 32 in the deadbolt retracted position when the trigger bolt 56 is in the trigger bolt extended position. The trigger 54 releases the deadbolt 32 from the deadbolt retracted position when the trigger bolt 56 is driven inward toward the trigger bolt inserted position.

A bolt retractor, generally indicated at 60 in FIGS. 3–6, includes an inner bolt retractor hub shown at 62 in FIG. 2 and an outer bolt retractor hub shown at 64 in FIGS. 2–6. The bolt retractor hubs 62, 64 are journaled to independently rotate relative to each other within the housing. As shown in FIG. 2, the inner bolt retractor hub 62 is journaled in a circular journal aperture 66 in the case side wall 28. As is also shown in FIG. 2, the outer bolt retractor hub 64 is journaled in a circular journal aperture 68 in the side cover 14.

A bolt retractor arm, generally indicated at 70 in FIGS. 2–6, operatively connects to the blocker 52 to release the blocker 52 in response to bolt retractor hub rotation. The bolt retractor arm is preferably formed from steel and is pivotally mounted at a lower end 72 of the bolt retractor arm 70 to the transverse post 25 disposed in a lower aft corner of the case 12.

In response to the clockwise or counter-clockwise rotation of either one or both of the inner 62 and outer 64 hubs, an upper bearing surface 74 of the bolt retractor arm 70 directly contacts and applies inward retraction pressure to an aluminum tailpiece portion 76 of the deadbolt 32. The upper bearing surface 74 contacts a vertically-oriented tailpiece lip 77 that extends integrally and perpendicularly from along an inner end of the deadbolt tailpiece 76 as shown in FIGS. 2–5.

When either of the hubs 62, 64 is rotated clockwise, as viewed in FIGS. 3–6, a lower cam lobe 78 extending from the rotated hub turns and bears upward against a lower transverse ramped surface 80 of the bolt retractor arm 70. This causes the bolt retractor arm 70 to rotate counterclockwise. When either of the hubs 62, 64 is rotated counterclockwise, as viewed in FIGS. 3–6, an upper cam lobe 82 extending from the rotated hub turns and bears downward against an upper transverse ramped surface 84 of the bolt retractor arm 70. This also causes the bolt retractor arm 70 to rotate counterclockwise. When the rotation of either hub 62, 64 causes the bolt retractor arm 70 to rotate in this manner, the bolt retractor arm 70 applies inward retraction force directly to the tailpiece lip 77 of the deadbolt 32.

As explained above, when either of the bolt retractor hubs 62, 64 is rotated in either direction, it causes the bolt retractor arm 70 to pivot inward. As is shown in FIGS. 3 and 4, when the bolt retractor arm 70 pivots inward, an arcuate trip surface in the form of a convex cam lobe 86 disposed on an upper edge of the bolt retractor arm 70 applies direct upward and inward pressure to a blocker cam surface 88. This upward and inward pressure pushes the blocker 52 upward out of the deadlock position and out of engagement with the deadbolt 32 as shown in FIG. 4. This frees the deadbolt 32 to move out of the deadbolt extended position.

A latch bolt, generally indicated at 90 in FIGS. 2–6, is reciprocally movable within the housing between a latch bolt extended position shown in FIGS. 3 and 6 and a latch bolt retracted position shown in FIG. 5. A bolt portion 92 of the latch bolt 90 protrudes outward through the front plates 16, 18 in the latch bolt extended position and is withdrawn almost entirely into the housing in the latch bolt retracted position.

A latch bolt biasing mechanism, generally indicated at 94 in FIGS. 3–6, is mounted within the housing and biases the latch bolt 90 toward the latch bolt extended position. The biasing mechanism 94 includes a coil extension-type latch spring shown at 96 in FIGS. 2–6. The latch spring 96 is coaxially disposed around a spring rod portion 97 of the latch bolt 90. The latch spring 96 is compressed between the bolt portion 92 of the latch bolt 90 and a slide support bracket 100 that extends integrally outward from the side wall portion 28 of the case 12 toward the side cover 14.

When an operator rotates either or both of the bolt hubs 62, 64 either clockwise or counter-clockwise the bolt retractor arm 70 swings inward and directly contacts a latch bolt bearing surface 98. The bolt bearing surface 98 is located on a square metal plate fixed transversely across an inner end of the spring rod portion 97 of the latch bolt 90. The spring rod portion 97 of the latch bolt 90 has an outer end that is fixed to an inner surface of the bolt portion 92 of the latch bolt 90. The latch bolt spring rod 97 is slidably supported for longitudinal reciprocal motion in the slide support bracket 100. As the bolt retractor arm 70 swings inward, it moves the latch bolt 90 to the latch bolt retracted position. When the bolt retractor arm 70 is released, the coil extension spring 96 of the latch bolt biasing mechanism 94 drives the latch bolt 90 back to the latch bolt extended position.

In addition to being engageable and retainable in a deadbolt retracted position, the deadbolt 32 can also be engaged and retained in either of two deadbolt semi-retracted positions when the trigger bolt 56 is in the trigger bolt extended position. The two deadbolt semi-retracted positions are spaced incrementally outward from the deadbolt retracted position shown in FIGS. 5 and 6, toward the deadbolt extended position shown in FIG. 3. The deadbolt 32 can be released from the deadbolt semi-retracted positions in the same way that it is released from the deadbolt retracted position, i.e., when the trigger bolt 56 is driven inward toward the trigger bolt inserted position.

To retain the deadbolt 32 in the deadbolt retracted and the two semi-retracted positions, the deadbolt 32 includes first, second and third trigger notches shown at 102, 104 and 106, respectively, in FIGS. 3–6. The trigger notches 102–106 are formed transversely across a lower surface of the deadbolt 32 perpendicular to the direction of deadbolt reciprocal movement. Each trigger notch 102–106 has a trapezoidal profile with a downwardly and outwardly angled wall at an outer end of each notch 102–106 and a vertical detent wall at an inner end of each notch 102–106. The first notch 102 corresponds to the retracted, i.e., the "fully" retracted deadbolt position and is deeper than the second 104 and third 106 notches that correspond to the deadbolt semi-retracted positions.

The trigger 54 includes a trigger link, shown at 108 in FIGS. 2–6. A vertically-oriented upper deadbolt engagement edge 110 of the trigger link 108 is selectively engageable with any one of the three trigger notches 102–106. The deadbolt engagement edge 110 engages the first trigger notch 102 when the deadbolt 32 is in the deadbolt retracted position and engages one of the second 104 and third 106 trigger notches when the deadbolt 32 is in one of the two deadbolt semi-retracted positions. The trigger notches 102–106 and the deadbolt engagement edge 110 are disposed transverse to the direction that the deadbolt 32 moves.

The trigger link 108 is mounted in the housing for vertical reciprocal movement between a trigger link engaged position shown in FIG. 6 and a trigger link retracted position shown in FIGS. 3–5. The trigger link 108 includes a flat metal plate portion 112 that lies flush against the case side wall 28. An upper guide slot 114 and a lower guide slot 116 are formed in the flat metal plate portion 112 of the trigger link 108. The upper guide slot 114 is a closed slot formed interiorly of the trigger link plate portion 112. The lower guide slot 116 is an open slot cut into a lower edge of the trigger link plate portion 112.

Transverse post 24 passes through the upper guide slot 114 and an open end of the lower guide slot 116 slidably engages a generally cylindrical peg 118 that integrally extends from the case side wall 28 below transverse post 24. The transverse post 24 and the peg 118 serve to slidably support the trigger link 108 as the trigger link 108 reciprocates between the trigger link engaged and retracted positions.

A tubular spacer bushing, shown at 120 in FIGS. 2-6, is coaxially disposed around transverse post 24 between the plate portion 112 of the trigger link 54 and the side cover 14. The spacer bushing holds the plate portion 112 of the trigger link 54 flat against the case side wall 28.

The deadbolt engagement edge 110 is disposed on a tab portion 122 of the trigger link 108. As is best shown in FIG. 2, the trigger link tab portion 122 integrally extends from an upper inner edge of the trigger link plate portion 112 and is bent at a right angle to the plate portion 112. The right angle bend causes the tab portion 122 to extend transversely from the plate portion 112 toward the side cover 14. As described above, the deadbolt engagement edge 110 engages the trigger detents 102-106 when the trigger link 108 is in the trigger link engaged position shown in FIG. 6. The right-angle bend in the tab 122 allows the deadbolt engagement edge 110 to engage the three trigger detents 102–106 transversely, i.e., perpendicular to the direction of deadbolt travel.

A trigger biasing mechanism, generally indicated at 124 in FIGS. 3–6 is mounted within the housing and continuously biases the trigger link 108 toward the trigger link engaged position shown in FIG. 6. The trigger biasing mechanism 124 includes a torsion-type trigger spring shown at 126 in FIGS. 2–6. The trigger spring 126 is coaxially disposed around the spacer bushing 120. An inner end 128 of the trigger spring 126 engages a notch 130 in the lower edge of a trigger link arm 132 that extends integrally from the inner edge of the trigger link plate portion 112. As is best shown in FIG. 2, the trigger link arm 132 is bent at a right angle to the trigger link plate portion 112 and extends transversely from the plate portion 112 toward the side cover 14. The inner end 128 of the trigger spring 126 applies constant upward force to the trigger link arm 132 to bias the trigger link 108 upward into the trigger link engaged position shown in FIG. 6.

The trigger bolt 56 is operatively connected to the trigger link 108. When the trigger bolt 56 moves against the trigger link biasing force from the trigger bolt extended position toward the trigger bolt inserted position, the trigger bolt 56 drives the trigger link 108 downward into the trigger link retracted position shown in FIGS. 3–5.

The type of acetyl resin that the trigger bolt 56 is primarily composed of is preferably DUPONT DELRIN®. DUPONT DELRIN® is preferable because, in addition to its natural lubricity, it also possesses other desirable properties. These properties include high tensile strength, impact resistance, stiffness, fatigue endurance, dimensional stability and resilience.

The trigger bolt 56 also includes a wing-like metal cam follower 132 formed transversely through a tailpiece portion 134 of the trigger bolt 56. One end of the cam follower 132, shown only in FIG. 2, is slidably disposed within a horizontally-disposed elongated cam slot 136 formed in the trigger link 108 and best shown in FIG. 2. The cam follower 132 coacts with a ramp 138 in the cam slot 136 to drive the trigger link 108 downward from the trigger link engaged position to the trigger link retracted position. This occurs when the trigger bolt 56 is driven inward from the trigger bolt extended position to the trigger bolt inserted position.

The trigger spring 126 is a double-acting spring with an outer end 140 that engages the trigger bolt 56 through a spring wire aperture 142 in the trigger bolt tailpiece 134 and biases the trigger bolt 56 outward toward the trigger bolt extended position shown in FIG. 6. Therefore, when the trigger bolt 56 is released from the trigger bolt inserted position, the trigger spring 126 drives the trigger bolt 56 outward to the trigger bolt extended position while driving the trigger link 108 upward toward the trigger link engaged position.

The dead lock blocker 52 includes a blocker arm 144 mounted in the housing for reciprocal pivotal movement between a dead lock position shown in FIG. 3 and a blocker retracted position shown in FIGS. 5 and 6. The blocker arm 144 is formed from a flat metal plate and has an elongated shape that is narrower at a rounded inner end 146 as well as at a squared-off outer end 148 of the arm. The blocker arm 144 is wider at a mid-section 150 of the arm. A blocker cam 145 is operatively engaged within a blocker cam slot 147. The rotary position of the blocker cam 145 signals a microprocessor (not shown) whether or not the room behind the door is occupied.

A circular aperture, shown at 152 in FIG. 2, extends through the inner end 146 of the blocker arm 144 and is coaxially disposed around the transverse post shown at 21 in FIGS. 2–6. The blocker arm 144 lies parallel to the case side wall 28 and is spaced from the case side wall 28 by a spacer 156 disposed coaxially around transverse post 21 between the blocker arm 144 and the case side wall 28. The blocker arm 144 pivots up and down about transverse post 21. At a lower limit of its pivotal travel shown in FIG. 3, the blocker arm 144 is in the dead lock position. At an upper limit of its pivotal travel shown in FIGS. 5 and 6, the blocker arm 144 is in its retracted position.

The blocker arm 144 releasably engages the deadbolt 32 whenever the deadbolt 32 is in the deadbolt extended position and the blocker arm 144 is in the dead lock position. In the dead lock position, a right-angled notch 156 formed in the outer end 148 of the blocker arm 144 engages an inward upper corner 158 of the bolt portion 34 of the deadbolt 32. In this position, the blocker arm 144 prevents the deadbolt 32 from moving inward out of the deadbolt extended position.

As the blocker arm 144 is moved to its retracted position, a lower edge 160 of the blocker arm 144 slidably engages the inward upper corner 158 of the bolt portion 34 of the deadbolt 32. As the deadbolt 32 is drawn inward toward the deadbolt retracted position, the inward upper corner 158 of the bolt supports the blocker arm 144 and drives the blocker arm 144 the remaining distance to the blocker retracted position as shown in FIGS. 5 and 6. The blocker arm 144 does not restrict deadbolt 32 motion once the blocker arm 144 has been moved from the dead lock position shown in FIG. 3.

The dead lock blocker 52 also includes a blocker biasing mechanism, generally indicated at 162 in FIGS. 3-6. The blocker biasing mechanism 162 is mounted within the housing and continuously biases the blocker arm 144 downward toward the dead lock position shown in FIG. 3. The dead lock blocker 52 includes a blocker spring shown at 164 in FIGS. 2–6. The blocker spring 164 is a torsion-type spring with an inner end 166 that bears against the back wall 48 of the case 12. An outer end 168 of the spring 164 bears downward on an upper edge 170 of the blocker arm 144, biasing the blocker arm 144 downward into the dead lock position.

The blocker cam surface 88 of the dead lock blocker 52 is disposed on a blocker tab portion 172 of the blocker arm 144. The blocker tab 172 extends integrally downward from the lower edge of the blocker arm 144 and includes two right-angle bends that position a lower tab portion 174 of the blocker tab 172 flat against the case side wall 28. The lower tab portion 174 slides against the case side wall 28 as the blocker arm 144 pivots between the dead lock position and the blocker arm 144 retracted position.

A lower edge of the lower tab portion of the blocker tab 172 comprises the blocker cam surface 88. The blocker cam surface 88 comprises two relatively straight sections joined by a rounded section to form a convex, downwardly-extending peaked profile as shown in FIGS. 3–6. When the bolt retractor arm 70 rotates inward in response to hub rotation, the trip surface 86 of the bolt retractor arm 70 rotates against the blocker cam surface 88, driving the blocker arm 144 upward out of the dead lock position.

The deadbolt biasing mechanism 44 includes an elongated deadbolt spring rod shown at 176 in FIGS. 2–6. The deadbolt spring rod 176 is horizontally and coaxially disposed within the throw spring 46. The throw spring 46 and deadbolt spring rod 176 are slidably disposed within an elongated spring slot 178 formed horizontally along one side of the deadbolt tailpiece portion 76.

The spring rod 176 has a first end fixed to the back wall 48 of the case 12 and a second end slidably and coaxially supported within a spring rod washer 180. The spring rod washer 180 is disposed vertically and held by spring biasing force against a slot detent 182 adjacent an outer end of the slot 178. The throw spring 46 has an outer diameter that is greater than an inner diameter of the spring rod washer 180.

As is best shown in FIG. 2, the spring rod first end is fastened into a circular aperture 182 disposed in the back wall 48 of the case 12 by employing an E-clip 184. The spring is compressed and retained between the spring rod washer 180 and the E-clip 184 at the back wall 48 of the case 12.

The first deadbolt stop 40 is disposed above the bolt portion 34 and the second deadbolt stop 42 is disposed below the bolt portion 34 of the deadbolt 32 as is best shown in FIGS. 3–6. The deadbolt stops 40, 42 extend integrally from the deadbolt 32 and are disposed forward of a deadbolt tailpiece center of mass so that most of the deadbolt tailpiece 76 is placed under compressive loads when the deadbolt stops 40, 42 hit the housing stops 36, 38.

As is best shown in FIG. 2, the first deadbolt stop 40 has a generally trapezoidal profile. Transverse post 22, disposed adjacent an upper end of the inside front plate 16, serves as the first housing stop 36. A forward wall 186 of the first deadbolt stop 40 has a concave arcuate shape that helps distribute impact forces when the first deadbolt stop 40 strikes a convex curved outer surface of the first housing stop 36.

As is best shown in FIG. 4, the second deadbolt stop 42 is disposed in a lower forward corner of the deadbolt 32 formed where the bolt portion 34 of the deadbolt 32 joins the deadbolt tailpiece 76. Transverse post 23, disposed adjacent the inside front plate 16 and directly below the first housing stop 36, serves as the second housing stop 38. A forward wall of the second deadbolt stop 42 shown at 188 in FIG. 4, has a concave arcuate shape that helps distribute impact forces when the second deadbolt stop 42 strikes a convex curved outer surface of the second housing stop 38.

The retractor arm 70 of the present invention applies force directly to the deadbolt 32 rather than transferring the force through an intermediate linkage. Therefore, it minimizes the amount of rotational force that an operator must apply via a door lever handle to either of the bolt retractor hubs 62, 64 to move the deadbolt 32 from the deadbolt engaged position to the deadbolt retracted position. In addition, the use of a coil extension spring as the throw spring 46 provides a more gradual spring-rate curve and longer spring life than the torsion springs used in the prior art. Still further, the natural lubricity of the low friction plastic DUPONT DELRIN® that forms the bolt portion 58 of the trigger bolt 56 minimizes door closing forces. The natural lubricity reduces closing forces by allowing the bolt portion 58 to slide easily against the strike plate on the door jamb (not shown) when the strike plate forces the trigger bolt 56 inward as the door is closed. Still further, the transverse orientation of the trigger notches 102–106 and the deadbolt engagement edge 110 of the present invention minimizes deadbolt wear by distributing engagement forces within and along the trigger detents 102–106 in the deadbolt 32. Still further, the positioning of the deadbolt stops 40, 42 reduces the likelihood of deadbolt breakage by placing the deadbolt tailpiece 76 under compressive loads and by preventing "cocking" when the deadbolt 32 is thrown to its extended position.

The above description illustrates embodiments of the present invention by using descriptive rather than limiting words. Obviously, there are many ways that one might modify these embodiments while remaining within the scope of the claims. In other words, there are many other ways that one may practice the present invention without exceeding the scope of the claims.

We claim:

1. A mortise lock assembly for mounting in a door opposite a strike plate on a doorjamb, the assembly comprising:

a housing;

a deadbolt reciprocally movable within the housing between a deadbolt extended position and a deadbolt retracted position, a portion of the deadbolt protruding outward from the housing in the deadbolt extended position and disposed generally within the housing in the deadbolt retracted position, the deadbolt comprising a first deadbolt stop, the housing comprising a first housing stop engageable with the first deadbolt stop when the deadbolt is in the deadbolt extended position to restrain the deadbolt against further outward movement;

a deadbolt biasing mechanism mounted within the housing and continuously biasing the deadbolt in an outward direction toward the deadbolt extended position;

a dead lock blocker mounted within the housing and engageable with the deadbolt when the deadbolt is in the deadbolt extended position to releasably restrain the deadbolt against inward movement;

a deadbolt trigger comprising a trigger bolt reciprocally moveable within the housing between a trigger bolt extended position and a trigger bolt inserted position, a bolt portion of the trigger bolt protruding outward from the housing in the trigger bolt extended position and disposed generally within the housing in the trigger bolt inserted position, the trigger releasably engaging and retaining the deadbolt in the deadbolt retracted position when the trigger bolt is in the trigger bolt extended position, the trigger releasing the deadbolt from the deadbolt retracted position when the trigger bolt is driven inward toward the trigger bolt inserted position; and a bolt retractor including a bolt retractor hub journaled to rotate within the housing and a separate bolt retractor arm moveably supported in the housing adjacent the hub, the bolt retractor arm configured to engage and cause the blocker to release the deadbolt in response to either clockwise or counterclockwise bolt retractor hub rotation;

the bolt retractor arm directly contacting and applying inward pressure to the deadbolt in response to bolt retractor hub rotation to minimize the amount of rotational force that an operator must apply via a door handle to the bolt retractor hub to move the deadbolt from the deadbolt engaged position to the deadbolt retracted position.

2. A mortise lock assembly as defined in claim 1 in which a trip surface disposed on the bolt retractor arm applies direct pressure to the blocker arm in response to bolt retractor hub rotation, moving the blocker out of the dead lock position and freeing the deadbolt to move out of the deadbolt extended position.

3. A mortise lock assembly as defined in claim 1 further including:

a latch bolt reciprocally movable within the housing between a latch bolt extended position and a latch bolt retracted position, a portion of the a latch bolt protruding outward from the housing in the latch bolt extended position and disposed generally within the housing in the latch bolt retracted position;

a latch bolt biasing mechanism mounted within the housing and biasing the latch bolt toward the latch bolt extended position;

the bolt retractor arm operatively engageable with the latch bolt to move the latch bolt to the latch bolt retracted position in response to hub rotation.

4. A mortise lock assembly as defined in claim 1 in which:

the deadbolt is engageable and retainable in a deadbolt semi-retracted position when the trigger bolt is in the trigger bolt extended position, the deadbolt semi-retracted position spaced incrementally outward from the deadbolt retracted position toward the deadbolt extended position; and the deadbolt is releasable from the deadbolt semi-retracted position when the trigger bolt is driven inward toward the trigger bolt inserted position.

5. A mortise lock assembly as defined in claim 4 in which:

the deadbolt includes first and second trigger detents disposed in an outer surface of the deadbolt;

the trigger includes a deadbolt engagement edge selectively engageable with the trigger detents; and the deadbolt engagement edge engages the first trigger detent when the deadbolt is in the deadbolt retracted position and engages the second trigger detent when the deadbolt is in the deadbolt semi-retracted position.

6. A mortise lock assembly as defined in claim 5 in which the trigger detents and the deadbolt engagement edge are disposed transverse to the direction of deadbolt motion.

7. A mortise lock assembly as defined in claim 5 in which the trigger includes:

a trigger link mounted in the housing for reciprocal movement between a trigger link engaged position and a trigger link retracted position; and a trigger biasing mechanism mounted within the housing and continuously biasing the trigger link toward the trigger link engaged position; and in which the deadbolt engagement edge is disposed on the trigger link, the edge engaging the trigger detents when the trigger link is in the trigger link engaged position and being spaced from the deadbolt when the trigger link is in the trigger link retracted position; and the trigger bolt is operatively connected to the trigger link and drives the trigger link to the trigger link retracted position when the trigger bolt moves from the trigger bolt extended position toward the trigger bolt inserted position.

8. A mortise lock assembly as defined in claim 1 in which the trigger bolt comprises a material that possesses sufficient natural lubricity to provide the trigger bolt with a friction coefficient less than of steel.

9. A mortise lock assembly as defined in claim 7 in which the trigger bolt comprises a metal cam follower operatively engageable with a cam slot in the trigger link.

10. A mortise lock assembly as defined in claim 7 in which the trigger biasing mechanism includes a double-acting spring that biases the trigger bolt outward toward the trigger bolt extended position while biasing the trigger link toward the trigger link engaged position.

11. A mortise lock assembly as defined in claim 1 in which the dead lock blocker includes:

a blocker arm mounted in the housing for reciprocal movement between a dead lock position and a blocker retracted position; and a blocker biasing mechanism mounted within the housing and continuously biasing the blocker arm toward the dead lock position, the blocker arm releasably engaging the deadbolt when the deadbolt is in the deadbolt extended position and the blocker arm is in the dead lock position.

12. A mortise lock assembly for mounting in a door opposite a strike plate on a door jamb, the assembly comprising:

a housing;

a deadbolt reciprocally movable within the housing between a deadbolt extended position and a deadbolt retracted position, a portion of the deadbolt protruding outward from the housing in the deadbolt extended position and disposed generally within the housing in the deadbolt retracted position, the deadbolt comprising a deadbolt stop, the housing comprising a housing stop engageable with the deadbolt stop when the deadbolt is in the deadbolt extended position to restrain the deadbolt against further outward movement;

a deadbolt biasing mechanism including a coil extension-type throw spring mounted within the housing and continuously biasing the deadbolt outwardly toward the deadbolt extended position, the throw spring having longitudinal axis aligned generally parallel to the direction that the spring applies biasing force to the deadbolt;

a dead lock blocker mounted within the housing, the dead lock blocker engageable with the deadbolt when the deadbolt is in the deadbolt extended position to releasably restrain the deadbolt against inward movement;

a deadbolt trigger comprising a trigger bolt reciprocally moveable within the housing between a trigger bolt extended position and a trigger bolt inserted position, the trigger bolt comprising a polymeric material, a bolt portion of the trigger bolt protruding outward from the housing in the trigger bolt extended position and disposed generally within the housing in the trigger bolt inserted position, the trigger releasably engaging and retaining the deadbolt in the deadbolt retracted position when the trigger bolt is in the trigger bolt extended position, the trigger releasing the deadbolt from the deadbolt retracted position when the trigger bolt is driven inward toward the trigger bolt inserted position; and a bolt retractor including a bolt retractor hub journaled to rotate within the housing and a separate bolt retractor arm moveably supported in the housing adjacent the hub, the bolt retractor arm configured to engage and cause the blocker to release the deadbolt in response to either clockwise or counterclockwise bolt retractor hub rotation;

the bolt retractor arm operatively connected to the deadbolt to retract the deadbolt in response to bolt retractor hub rotation to allow an operator to retract the deadbolt by applying force to a door handle connected to the bolt retractor hub.

13. A mortise lock assembly as defined in claim 12 in which the deadbolt biasing mechanism includes an elongated spring rod coaxially disposed within the throw spring, the spring rod having a first end fixed to the housing and a second end slidably supported within an aperture disposed on the deadbolt, the spring diameter being greater than that of the aperture, and the spring disposed between the housing and the aperture.

14. A mortise lock assembly as defined in claim 13 in which the spring and springrod are slidably disposed within an elongated slot formed in a tailpiece portion of the deadbolt, said tailpiece portion integrally extending inward from said bolt portion of said deadbolt.

15. A mortise lock assembly as defined in claim 12 in which the deadbolt comprises aluminum.

16. A mortise lock assembly for mounting in a door opposite a strike plate on a door jamb, the assembly comprising:

a housing;

a deadbolt reciprocally movable within the housing between a deadbolt extended position and a deadbolt retracted position, a bolt portion of the deadbolt protruding outward from the housing in the deadbolt extended position and disposed generally within the housing in the deadbolt retracted position, the deadbolt comprising first and second deadbolt stops, the housing comprising first and second housing stops engageable with the respective first and second deadbolt stops when the deadbolt is in the deadbolt extended position to restrain the deadbolt against further outward movement;

a deadbolt biasing mechanism mounted within the housing and continuously biasing the deadbolt in an outward direction toward the deadbolt extended position;

a dead lock blocker mounted within the housing, the dead lock blocker engageable with the deadbolt when the deadbolt is in the deadbolt extended position to releasably restrain the deadbolt against inward movement;

a deadbolt trigger comprising a trigger bolt reciprocally moveable within the housing between a trigger bolt extended position and a trigger bolt inserted position, a bolt portion of the trigger bolt protruding outward from the housing in the trigger bolt extended position and disposed generally within the housing in the trigger bolt inserted position, the trigger releasably engaging and retaining the deadbolt in the deadbolt retracted position when the trigger bolt is in the trigger bolt extended position, the trigger releasing the deadbolt from the deadbolt retracted position when the trigger bolt is driven inward toward the trigger bolt inserted position; and a bolt retractor including a bolt retractor hub journaled to rotate within the housing and a separate bolt retractor arm moveably supported in the housing adjacent the hub, the bolt retractor arm configured to engage and cause the blocker to release the deadbolt in response to either clockwise or counterclockwise bolt retractor hub rotation;

the bolt retractor arm operatively connected to the deadbolt to retract the deadbolt in response to bolt retractor hub rotation to allow an operator to retract the deadbolt by applying force to a door handle connected to the bolt retractor hub.

17. A mortise lock assembly as defined in claim 16 in which the first deadbolt stop is disposed above the bolt portion and the second deadbolt stop is disposed below the bolt portion.

18. A mortise lock assembly as defined in claim 17 in which the deadbolt stops are disposed forward of a deadbolt tailpiece center of mass.

19. A mortise lock assembly for mounting in a door opposite a strike plate on a door jamb, the assembly comprising:

a housing;

a deadbolt reciprocally movable within the housing between a deadbolt extended position and a deadbolt retracted position, a portion of the deadbolt protruding outward from the housing in the deadbolt extended position and disposed generally within the housing in the deadbolt retracted position, the deadbolt comprising a deadbolt stop, the housing comprising a housing stop engageable with the deadbolt stop when the deadbolt is in the deadbolt extended position to restrain the deadbolt against further outward movement;

a deadbolt biasing mechanism mounted within the housing and continuously biasing the deadbolt in an outward direction toward the deadbolt extended position;

a dead lock blocker mounted within the housing, the dead lock blocker engageable with the deadbolt when the deadbolt is in the deadbolt extended position to releasably restrain the deadbolt against inward movement;

a deadbolt trigger comprising a trigger bolt reciprocally moveable within the housing between a trigger bolt extended position and a trigger bolt inserted position, the trigger bolt comprising a polymeric material, a bolt portion of the trigger bolt protruding outward from the housing in the trigger bolt extended position and disposed generally within the housing in the trigger bolt inserted position, the trigger releasably engaging and retaining the deadbolt in the deadbolt retracted position when the trigger bolt is in the trigger bolt extended position, the trigger releasing the deadbolt from the deadbolt retracted position when the trigger bolt is driven inward toward the trigger bolt inserted position; and a bolt retractor including a bolt retractor hub journaled to rotate within the housing and a separate bolt retractor arm moveably supported in the housing adjacent the hub, the bolt retractor arm configured to engage and cause the blocker to release the deadbolt in response to either clockwise or counterclockwise bolt retractor hub rotation;

the bolt retractor arm operatively connected to the deadbolt to retract the deadbolt in response to bolt retractor hub rotation to allow an operator to retract the deadbolt by applying force to a door handle connected to the bolt retractor hub.

20. A mortise lock assembly as defined in claim 19 in which the trigger bolt comprises a material that possesses sufficient natural lubricity to provide the trigger bolt with a friction coefficient less than that of steel.

21. A mortise lock assembly as defined in claim 19 in which the trigger bolt comprises a metal cam follower operatively engageable with a cam slot in the trigger link.

22. A mortise lock assembly as defined in claim 19 in which:

the deadbolt is engageable and retainable in a deadbolt semi-retracted position when the trigger bolt is in the trigger bolt extended position, the deadbolt semi-retracted position spaced incrementally outward from the deadbolt retracted position toward the deadbolt extended position; and the deadbolt is releasable from the deadbolt semi-retracted position when the trigger bolt is driven inward toward the trigger bolt inserted position.

23. A mortise lock assembly as defined in claim 22 in which:

the deadbolt includes first and second trigger detents disposed in an outer surface of the deadbolt;

the trigger includes a deadbolt engagement edge selectively engageable with the trigger detents; and the deadbolt engagement edge engages the first trigger detent when the deadbolt is in the deadbolt retracted position and engages the second trigger detent when the deadbolt is in the deadbolt semi-retracted position.

24. A mortise lock assembly as defined in claim 23 in which the trigger detents and the deadbolt engagement edge are disposed transverse to the direction of deadbolt biasing force application.

25. A mortise lock assembly as defined in claim 23 in which the trigger includes:

a trigger link mounted in the housing for reciprocal movement between a trigger link engaged position and a trigger link retracted position; and a trigger biasing mechanism mounted within the housing and continuously biasing the trigger link toward the trigger link engaged position; and in which the deadbolt engagement edge is disposed on the trigger link, the edge engaging the trigger detents when the trigger link is in the trigger link engaged position; and the trigger bolt is operatively connected to the trigger link and drives the trigger link to the trigger link retracted position when the trigger bolt moves from the trigger bolt extended position toward the trigger bolt inserted position.

26. A mortise lock assembly as defined in claim 25 in which the trigger biasing mechanism includes a double-acting spring that biases the trigger bolt outward toward the trigger bolt extended position while biasing the trigger link toward the trigger link engaged position.

27. A mortise lock assembly for mounting in a door opposite a strike plate on a door jamb, the assembly comprising:

a housing;

a deadbolt reciprocally movable within the housing between a deadbolt extended position and a deadbolt retracted position, a portion of the deadbolt protruding outward from the housing in the deadbolt extended position and disposed generally within the housing in the deadbolt retracted position, the deadbolt comprising a deadbolt stop, the housing comprising a housing stop engageable with the deadbolt stop when the deadbolt is in the deadbolt extended position to restrain the deadbolt against further outward movement;

a deadbolt biasing mechanism mounted within the housing and continuously biasing the deadbolt in an outward direction toward the deadbolt extended position;

a dead lock blocker mounted within the housing, the dead lock blocker engageable with the deadbolt when the deadbolt is in the deadbolt extended position to releasably restrain the deadbolt against inward movement;

a deadbolt trigger comprising a trigger link and trigger bolt reciprocally moveable within the housing between a trigger bolt extended position and a trigger bolt inserted position, the trigger bolt comprising a polymeric material, a bolt portion of the trigger bolt protruding outward from the housing in the trigger bolt extended position and disposed generally within the housing in the trigger bolt inserted position, the trigger link releasably engaging and retaining the deadbolt in the deadbolt retracted position when the trigger bolt is in the trigger bolt extended position, the trigger link releasing the deadbolt from the deadbolt retracted position when the trigger bolt is driven inward toward the trigger bolt inserted position; and a bolt retractor including a bolt retractor hub journaled to rotate within the housing and a bolt retractor arm engageable with the blocker to release the blocker in response to bolt retractor hub rotation;

the bolt retractor arm operatively connected to the deadbolt to retract the deadbolt in response to bolt retractor hub rotation to allow an operator to retract the deadbolt by applying force to a door handle connected to the bolt retractor hub; and the trigger bolt comprising a metal cam follower operatively engageable with a cam slot in the trigger link.

* * * * *